US005924566A

United States Patent [19]

Gibbs

[11] Patent Number: 5,924,566

[45] Date of Patent: Jul. 20, 1999

[54] PLUNGER CADDY

[76] Inventor: Paul Stephen Gibbs, 201 Valley Rd., East Bend, N.C. 27018

[21] Appl. No.: 09/144,088

[22] Filed: Aug. 31, 1998

Related U.S. Application Data

[ 60] Provisional application No. 60/061,421, Oct. 8, 1997.

[51] Int. Cl.[6] ..... B65D 83/10

[52] U.S. Cl. ..... 206/361; 206/15.3; 220/833

[58] Field of Search ..... 206/349, 15.2, 206/15.3, 361, 394, 362.3, 818; 220/908, 833, 345.2, 826; D6/551, 525

[56] References Cited

U.S. PATENT DOCUMENTS

| | | | |
|---|---|---|---|
| D. 233,196 | 10/1974 | Fry . | |
| D. 276,291 | 11/1984 | Boroch . | |
| D. 298,712 | 11/1988 | Mattei . | |
| D. 315,269 | 3/1991 | Brazis . | |
| D. 334,681 | 4/1993 | Callicutt . | |
| 4,940,139 | 7/1990 | Sandt | 206/362.3 |
| 5,040,679 | 8/1991 | Rehmann . | |
| 5,102,001 | 4/1992 | Teague et al. | 220/908 |
| 5,114,006 | 5/1992 | Wilk . | |
| 5,305,880 | 4/1994 | Wilk et al. | 206/349 |
| 5,307,930 | 5/1994 | Wilk et al. | 206/349 |
| 5,456,356 | 10/1995 | Kurzawa . | |

*Primary Examiner*—Paul T. Sewell
*Assistant Examiner*—Nhan T. Lam
*Attorney, Agent, or Firm*—Richard C. Litman

[57] ABSTRACT

A decorative and functional plunger caddy device for storing a toilet plunger in the bathroom. The caddy device is transported by opening the door of the caddy device, inserting a toilet plunger into the caddy device and securing the door of the device so that the user may lift and carry the caddy device by holding the exposed handle of the toilet plunger.

14 Claims, 3 Drawing Sheets

PLUNGER CADDY

CROSS-REFERENCE TO RELATED APPLICATION

This application claims the benefit of U.S. Provisional Pat. application Ser. No. 60/061,421, filed Oct. 8, 1997.

BACKGROUND OF THE INVENTION

1. Field of the Invention

The present invention relates to a plunger caddy device for storing a toilet plunger in the bathroom. The caddy device can be transported by opening the door of the caddy device, inserting a toilet plunger into the caddy device and securing the door of the device so that the user may lift and carry the caddy device by holding the exposed handle of the toilet plunger.

2. Description of Related Art

Containers for toilet plungers and related articles have been developed in the past. However, such containers are difficult to carry and/or they did not blend in with the decor of the bathroom. The toilet plunger, by itself, is an unseemly sight in the bathroom and hence, it is literally hidden away, resulting in the inconvenience of searching for the plunger when it is most needed.

Accordingly, a need will be seen for a toilet plunger container or caddy that can easily be transported. Another need will be seen for a plunger caddy which blends in with the decor of the bathroom, so that the user does not have to hide the plunger and can conveniently access the plunger. In addition, there is a need for a device as described above that is easily and economically produced.

U.S. Pat. No. Des. 298,712 issued to Mattei on Nov. 29, 1988 illustrates a holder for a toilet bowl brush. The device includes an openable doorway that can enclose a toilet brush while exposing the handle of the brush. The device cannot be transported easily by the handle of the brush because the doorway cannot be secured. The device does not substantially hide the entire toilet brush and the device may not blend in with the decor of the bathroom.

U.S. Pat. No. Des. 315,269 issued to Brazis on Mar. 12, 1991 illustrates a toilet bowl brush caddy. The device includes an openable and closeable door through which a toilet brush can be stored, presumably, with a portion of the toilet brush handle extending out of the device. The device cannot be transported easily by the handle of the brush because the door cannot be secured. The device does not substantially hide the entire toilet brush. The device may not blend in with the decor of the bathroom.

U.S. Pat. No. Des. 276,291 issued to Boroch on Nov. 13, 1984 describes a bathroom brush holder with a brush. The device includes an openable and closeable doorway so that a brush may be inserted or removed from the holder. A tiltable internal housing for the brush is also provided. The device cannot be transported easily by the handle of the brush because the doorway cannot be secured. The device does not substantially hide the entire toilet brush and the device may not blend in with the decor of the bathroom.

U.S. Pat. No. 5,040,679 issued to Rehmann on Aug. 20, 1991 describes a toilet accessory for concealing toilet articles. The device has the outward appearance of a doll for concealing toilet paper rolls and/or a toilet plunger. This device cannot be transported by the handle of the plunger. The device hides the entire toilet plunger and accessing the plunger is difficult. In addition, the device may not blend in with the decor of the bathroom.

U.S. Pat. No. 5,114,006 issued to Wilk on May 19, 1992 describes a relatively complex container device for hiding the toilet plunger. The device includes a slide-out door for inserting or removing a toilet plunger. The device cannot be transported by the handle of the plunger. The device hides the entire toilet plunger and accessing the plunger is difficult. The device may not blend in with the decor of a bathroom and the device may be relatively costly to manufacture.

U.S. Pat. No. 5,456,356 issued to Kurzawa on Oct. 10, 1995 describes a toilet plunger accessory. The device is a combination toilet plunger and toilet tissue roll holder. The device covers the entire plunger. The device cannot be transported by the handle of the plunger. The device completely hides the entire toilet plunger and accessing the plunger may be difficult and the device may not blend in with the decor of a bathroom.

None of the above noted inventions and patents, taken either singly or in combination, is seen to describe the instant invention as claimed.

SUMMARY OF THE INVENTION

The present invention is a plunger caddy device for storing a toilet plunger in the bathroom. The caddy device can be transported by opening the door of the caddy device, inserting a toilet plunger into the caddy device and securing the door of the device so that the user may lift and carry the caddy device and the plunger by holding the exposed handle of the toilet plunger.

Accordingly, it is a principal object of the present invention to provide a plunger caddy which can effectively be transported easily by the handle of the plunger.

Another of the objects of the present invention is to provide a plunger caddy with an openable and closeable hatch to allow for the easy storage and removal of the plunger.

Yet another of the objects of the present invention is to provide a plunger caddy which can detachably secure the plunger portion of the plunger inside the caddy, while exposing a portion of the plunger handle.

Still another of the objects of the present invention is to provide a plunger caddy that substantially hides much of the plunger.

A further object of the present invention is to provide a plunger caddy that blends in with the decor of the bathroom.

A final object of the present invention is to provide a plunger caddy that is economical to produce.

These and other objects of the present invention will be more readily apparent as the nature of the invention is hereinafter more fully described, illustrated and claimed with reference being made to the attached drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
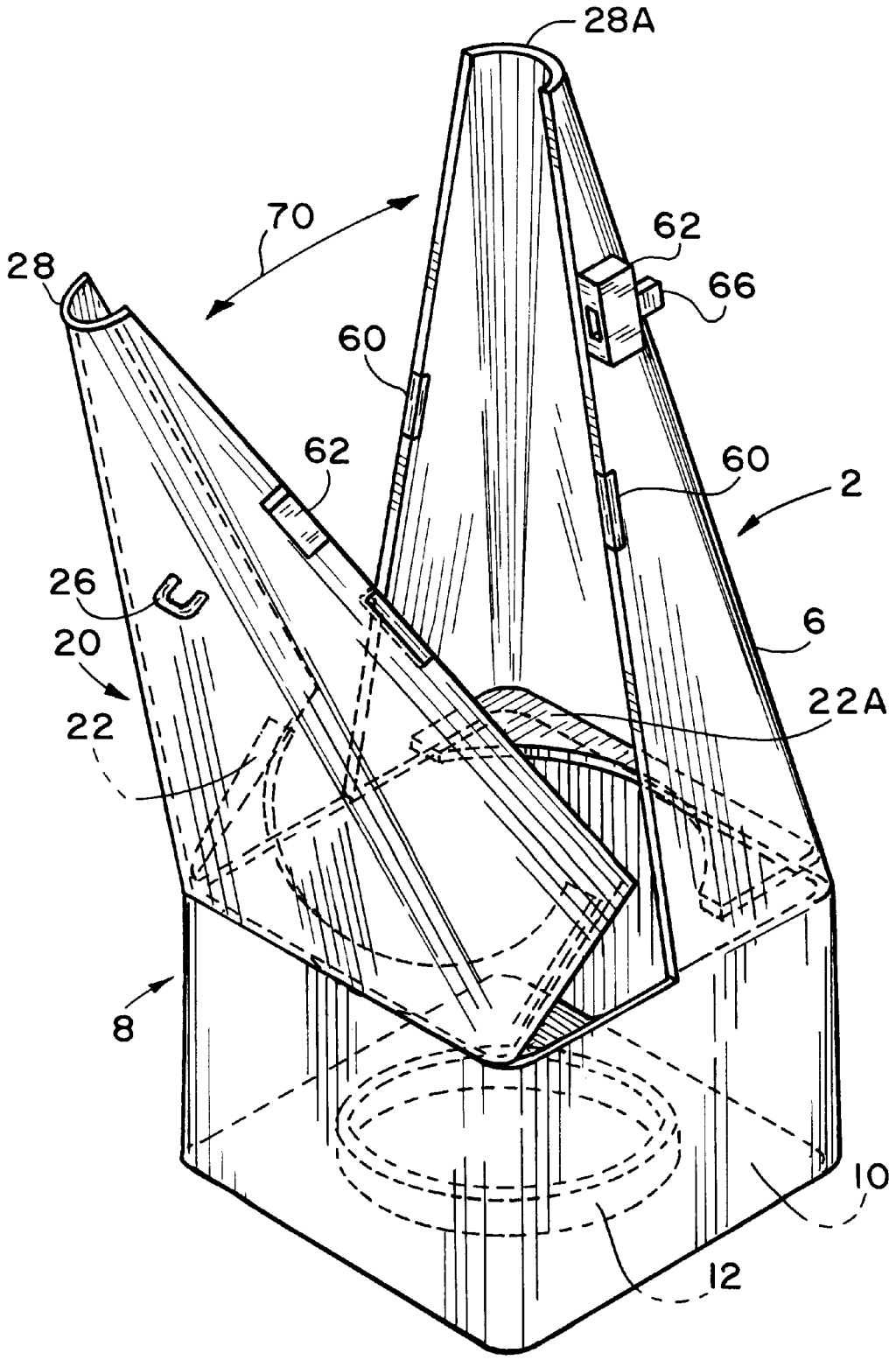
FIG. 1 is a perspective view of a plunger caddy with its hatch member swung open so that a plunger can be placed inside the caddy.

The present invention is a plunger caddy device for storing a toilet plunger in the bathroom. The caddy device can be transported by opening the door of the caddy device, inserting a toilet plunger into the caddy device and securing the door of the device so that the user may lift and carry the caddy device and the toilet plunger by holding the exposed handle of the toilet plunger.

Embodiments of the various aspects of the present invention will now be explained with reference to the accompanying drawings. By way of illustration and not limitation, FIGS. 1 to 4 are presented to show the preferred embodiment of the present invention.

In the preferred embodiment, the plunger caddy 2 for housing and transporting a toilet plunger has a base 8 which includes a floor section 10. The floor section 10 has a plunger guide 12 that is adapted to receive the plunger portion 52 of the plunger 56. The base 8 includes an upper section 6 that extends upward from the base 8 to form a first partial neck opening 28A. The upward section 6 includes a first lip section 22A that is configured to help secure the plunger portion 52 of the plunger 56 inside the caddy 2.

A hatch member 20 is hinged to the base 8 by a hinge 30. As shown in FIG. 1, the hatch member 20 can move in a radial direction 70. The hatch member 20 extends upward to form a second partial neck opening 28. The hatch member 20 includes a handle 26. The hatch section 20 has a second lip section 22 that is configured to help secure the plunger portion 52 of the plunger 56 inside the caddy 2.

The caddy 2 includes a locking mechanism for detachably securing the hatch member 20 to the base 8 so that the plunger 56 can be secured inside the caddy 2 with a portion of the handle 50 of the plunger 56 extending out of the caddy 2 through a plunger handle opening formed by adjacently placing the partial neck openings 28, 28A. The first and second lip sections 22, 22A restrict the upward movement of the plunger portion 52 when the hatch member 20 is enclosed so that the plunger portion 52 of the caddy 2 remains inside the caddy 2 when the handle 50 of the plunger 56 is pulled by the user to transport the secured plunger 56 and the caddy 2.

It is preferred that the caddy 2 is made substantially from either plastic, fiberglass or non-corrosive metal. It is also preferred that exterior surface of the base 8 blends in with the decor of the bathroom. It is preferred that the exterior surface of the base 8 is metallic silver, metallic gold, wood grain, white, pink, blue, etc. such that the color complements the decor of the bathroom.

Figure 2:
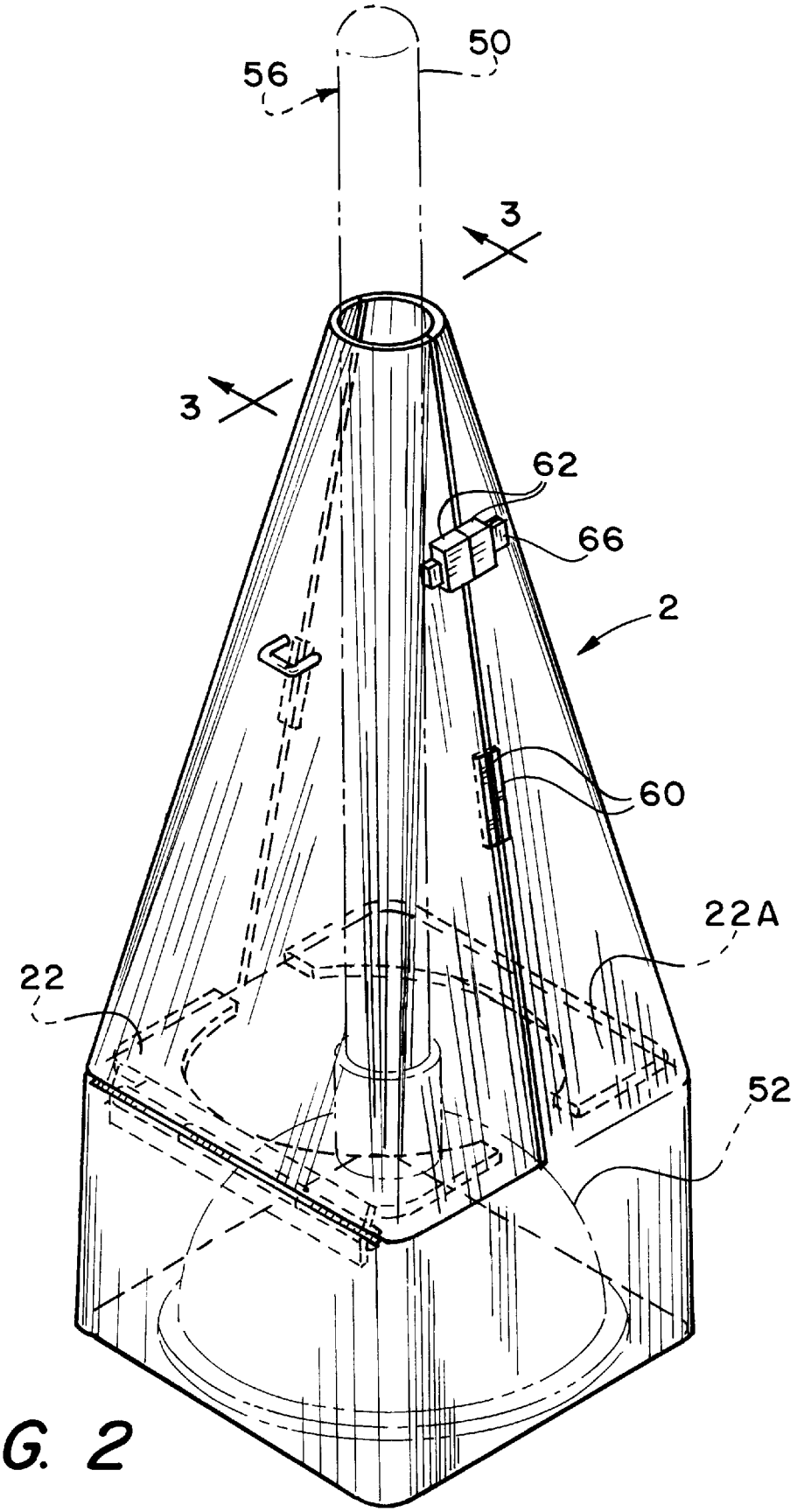
FIG. 2 is a perspective view of the plunger caddy of FIG. 1 with its hatch member in a closed position.
Figure 4:
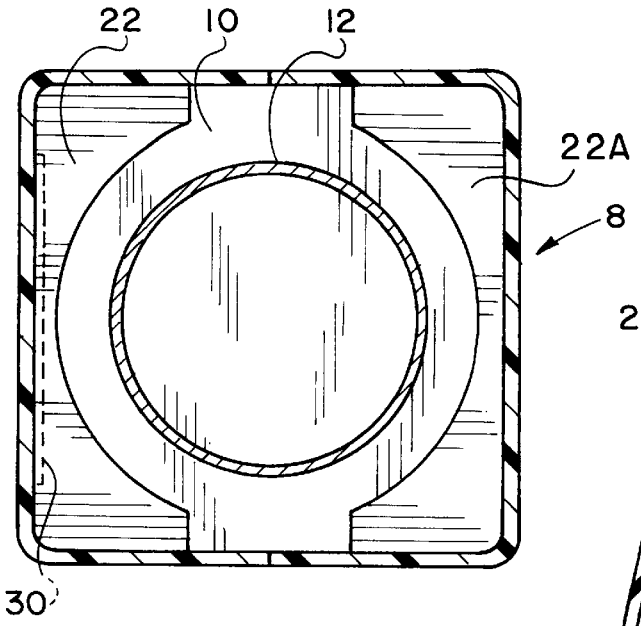
FIG. 4 is a sectional view along line 4—4 of the plunger caddy of FIG. 3.
Figure 3:
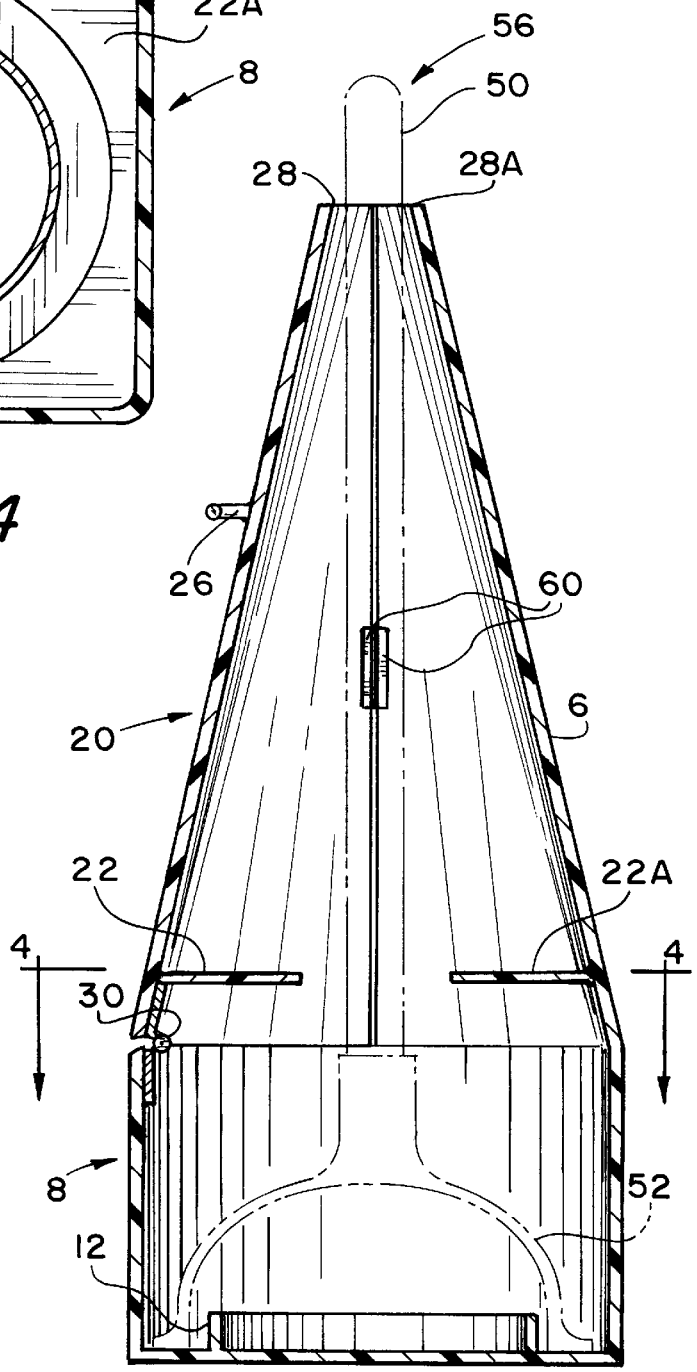
FIG. 3 is a sectional view along line 3—3 of the plunger caddy of FIG. 2.

It is preferred that the locking device for detachably securing the hatch member 20 onto the base 8 includes magnets 60 attached to the surfaces of the hatch member 20 and the upper section 6 of the base 8, such that when the hatch member 20 is flush against the base 8, the magnets 60 engage and detachably adhere the hatch member 20 to the upper section 6 of the base 8, as in FIG. 2.

It is also preferred that the locking device further includes a lock housing 62 in both the upper section 6 of the base 8 and the hatch member 20. A slide lock 66 frictionally and detachably engages the lock housings 62 of the upper section 6 and the hatch member 20 to lock the hatch member 20 to the upper section 6 of the base 8.

The plunger caddy of the present invention provides a readily accessible and convenient housing for an unsightly but very necessary household tool. The numerous advantages of the present invention include a decorative appearance, easy to open, easy to close, easy access in emergencies, durable, occupies only a minimum amount of space, and helps plunger to maintain the proper shape needed to produce adequate suction. The sleek contour of the plunger caddy enhances the decor of the room in which the plunger caddy is located making the plunger caddy both functional and decorative. It should be understood by those skilled in the art that various modifications and adaptations of the present invention as well as alternative embodiments of the present invention may be contemplated.

The preferred embodiment of the present invention disclosed herein is intended to be illustrative only and is not intended to limit the scope of the invention. It is to be understood that the present invention is not limited to the embodiment described above, but encompasses any and all embodiments within the scope of the following claims.

I claim:

1. A plunger caddy for housing and transporting a toilet plunger having a handle portion and a plunger portion, comprising:

a base having a floor section with on exterior surface, said floor section having a plunger guide adapted to receive the plunger portion of the plunger, said base including an upper section extending upward from said base to form a first partial neck opening, said upper section including a first lip section that is configured to help secure the plunger portion of the plunger inside the caddy;

a hatch member hinged to said base portion, said hatch member extending upward to form a second partial neck opening, said hatch member having a handle, said hatch section having a second lip section that is configured to help secure the plunger portion of the plunger in the caddy; and locking means for detachably securing said hatch member to said base such that the plunger can be secured inside the caddy with a portion of the handle of the plunger extending out of the caddy through a plunger handle opening formed by adjacently placing said partial neck openings, said first and second lip sections restricting the upward movement of the plunger portion when said hatch is enclosed so that the plunger portion of the caddy remains inside the caddy when said handle of the plunger is used to transport the secured plunger and the caddy.

2. The plunger caddy for housing and transporting a toilet plunger as recited in claim 1, wherein the exterior surface of said base includes a metallic luster finish.

3. The plunger caddy for housing and transporting a toilet plunger as recited in claim 1, wherein the exterior surface of said base has a wood grain image finish.

4. The plunger caddy for housing and transporting a toilet plunger as recited in claim 1, wherein the exterior surface color of said base is of a predetermined finish so as to blend in with the decor of a bathroom.

5. The plunger caddy for housing and transporting a toilet plunger as recited in claim 4, wherein the exterior surface color of said base is selected from a group consisting of white, pink, light blue, metallic gold, and metallic silver.

6. The plunger caddy for housing and transporting a toilet plunger as recited in claim 1, wherein said locking means includes magnets attached to said hatch member and said base, such that when said hatch member is flush against said base, said magnets engage and detachably adhere said hatch member to said base.

7. The plunger caddy for housing and transporting a toilet plunger as recited in claim 1, wherein the locking means further includes a lock housing in both the upper section of said base and the hatch member and a slide lock, said slide lock frictionally and detachably locking said hatch member to said upper section of said base.

8. The plunger caddy for housing and transporting a toilet plunger as recited in claim 1, wherein said base is made from a material selected from a group consisting of plastic, fiberglass, and non-corrosive metal.

9. A plunger caddy for housing and transporting a toilet plunger having a handle portion and a plunger portion, comprising:

a base having a floor section with an exterior surface, said floor section having a plunger guide adapted to receive the plunger portion of the plunger, said base including an upper section extending upward from said base to form a first partial neck opening, said upper section including a first lip section that is configured to help secure the plunger portion of the plunger inside the caddy;

a hatch member hinged to said base portion, said hatch member extending upward to form a second partial neck opening, said hatch member having a handle, said hatch section having a second lip section that is configured to help secure the plunger portion of the plunger in the caddy;

magnets attached to said hatch member and said base, such that when said hatch member is flush against said base, said magnets engage and detachably adhere said hatch member to said base such that the plunger can be secured inside the caddy with a portion of the handle of the plunger extending out of the caddy through a plunger handle opening formed by adjacently placing said partial neck openings, said first and second lip sections restricting the upward movement of the plunger portion when said hatch is enclosed so that the plunger portion of the caddy remains inside the caddy when said handle of the plunger is used to transport the secured plunger and the caddy; and a lock housing in both the upper section of said base and the hatch member and a slide lock, said slide lock frictionally and detachably locking said hatch member to said upper section of said base.

10. The plunger caddy for housing and transporting a toilet plunger as recited in claim 9, wherein the exterior surface of said base has a metallic luster finish.

11. The plunger caddy for housing and transporting a toilet plunger as recited in claim 9, wherein the exterior surface of said base has a wood grain image finish.

12. The plunger caddy for housing and transporting a toilet plunger as recited in claim 9, wherein the exterior surface color of said base is of a predetermined finish so as to blend in with the decor of a bathroom.

13. The plunger caddy for housing and transporting a toilet plunger as recited in claim 12, wherein the exterior surface color of said base is selected from a group consisting of white, pink, light blue, metallic gold, and metallic silver.

14. The plunger caddy for housing and transporting a toilet plunger as recited in claim 9, wherein said base is made from a material selected from a group consisting of plastic, fiberglass, and non-corrosive metal.

* * * * *